US012584076B2

(12) United States Patent
Nicol et al.

(10) Patent No.: US 12,584,076 B2
(45) Date of Patent: Mar. 24, 2026

(54) ENHANCED LUBRICANT COMPOSITION

(71) Applicant: GRAPHENE MANUFACTURING GROUP LTD, Enoggera (AU)

(72) Inventors: Craig Nicol, Brisbane (AU); Timothy Scheiwe, Brisbane (AU); Ashok Kumar Nanjundan, Brisbane (AU)

(73) Assignee: Graphene Manufacturing Group LTD, Enoggera (AU)

( * ) Notice: Subject to any disclaimer, the term of this patent is extended or adjusted under 35 U.S.C. 154(b) by 278 days.

(21) Appl. No.: 18/262,093

(22) PCT Filed: Sep. 28, 2021

(86) PCT No.: PCT/AU2021/051127

§ 371 (c)(1),
(2) Date: Jul. 19, 2023

(87) PCT Pub. No.: WO2022/155699

PCT Pub. Date: Jul. 28, 2022

(65) Prior Publication Data

US 2025/0277161 A1 Sep. 4, 2025

(30) Foreign Application Priority Data

Jan. 20, 2021 (AU) ..... 2021900116

(51) Int. Cl.

| | |
|---|---|
| ***C10M 125/02*** | (2006.01) |
| ***C10M 177/00*** | (2006.01) |
| *C10N 20/06* | (2006.01) |
| *C10N 50/00* | (2006.01) |

(52) U.S. Cl.

CPC ..... *C10M 125/02* (2013.01); *C10M 177/00* (2013.01); *C10M 2201/041* (2013.01); *C10N 2020/06* (2013.01); *C10N 2050/015* (2020.05)

(58) Field of Classification Search

CPC ..... C10N 2050/15; C10N 2020/06; C10N 125/02; C10N 177/00; C10N 2201/041

See application file for complete search history.

(56) References Cited

U.S. PATENT DOCUMENTS

| | | | | |
|---|---|---|---|---|
| 2011/0046026 | A1 | 2/2011 | Xiao | |
| 2013/0324447 | A1 | 12/2013 | Tsou | |
| 2014/0134092 | A1 | 5/2014 | Shankman | |
| 2016/0276056 | A1* | 9/2016 | Stolyarov | C09D 11/38 |
| 2018/0128335 | A1 | 5/2018 | Sin Xicola | |

FOREIGN PATENT DOCUMENTS

| | | | |
|---|---|---|---|
| CN | 107236581 | A | 10/2017 |
| CN | 108117913 | A | 6/2018 |
| CN | 110437910 | A | 11/2019 |
| CN | 111979022 | A | 11/2020 |
| WO | 2013093358 | A1 | 6/2013 |

OTHER PUBLICATIONS

Office Action issued Jan. 9, 2025 in European Patent Application No. 21920153.0.

Extended European Search Report issued May 16, 2024 in European Patent App. No. 21920153.0.

Office Action dated Jul. 25, 2025 in Chinese Appl. No. 202180091275.9.

Search Report dated Jul. 23, 2025 in Chinese Appl. No. 202180091275.9.

Research on the Thermal and Electrical Properties of Graphene Materials-From the Perspective of Anharmonic Effects*, Zheng Ruilun et al., Southwest Jiaotong University Press, 1st Edition, 1st Printing, May 2019, pp. 021-023. and Machine Translation.

* cited by examiner

*Primary Examiner* — Vishal V Vasisth

(74) *Attorney, Agent, or Firm* — Cook Alex Ltd.

(57) ABSTRACT

Disclosed herein is a lubricant composition comprising a base oil or a fully formulated lubricant; and graphene nanoparticles derived from a carbon containing gas dispersed in the base oil or the fully formed lubricant.

17 Claims, No Drawings

ENHANCED LUBRICANT COMPOSITION

This application is a 371 of PCT/AU2021/051127, filed Sep. 28, 2021

FIELD

The invention relates to enhanced lubricant composition that comprises a base oil with graphene derived from a carbon containing gas and methods of forming such a lubricant composition.

BACKGROUND

Lubricants are important in mechanical devices to mitigate wear such as by reducing friction and wear and improving heat transfer between mechanical components and reducing corrosion and providing heat protection to mechanical components.

It is desirable to provide lubricants with enhanced properties, such as having increased lubricity, and/or co-efficient of friction to provide enhanced protection to mechanical components.

It is an object of the invention to address one or more shortcomings of the prior art and/or provide a useful alternative.

Reference to any prior art in this specification is not, and should not be taken as, an acknowledgement or any form of suggestion that the prior art forms part of the common general knowledge of a person skilled in the art.

SUMMARY OF INVENTION

In a first aspect of the invention, there is provided lubricant composition comprising:

a base oil or fully formulated lubricant; and graphene nanoparticles derived from a carbon containing gas dispersed in the base oil or fully formulated lubricant.

In a second aspect of the invention, there is provided a method for preparing a lubricant composition comprising:

dispersing graphene nanoparticles derived from a carbon containing gas in a base oil or fully formulated lubricant.

In one embodiment, the lubricant composition is a lubricant concentrate. In another embodiment, the lubricant composition is a finished lubricant.

In an embodiment, the graphene nanoparticles are present in an amount of from about 0.001 wt %. Preferably, the graphene nanoparticles are present in an amount of from about 0.01 wt %. More preferably, the graphene nanoparticles are present in an amount of from about 0.1 wt %. Even more preferably, the graphene nanoparticles are present in an amount of from about 1 wt %. Still more preferably, the graphene nanoparticles are present in an amount of from about 10 wt %.

In an embodiment, the graphene nanoparticles are present in an amount of up to about 20 wt %. However, in some embodiments, the graphene nanoparticles are present in an amount of up to about 10 wt %, 2 wt %, 1 wt % or 0.01 wt %. For example, in one or more forms the composition may comprise graphene nanoparticles in an amount of: 0.001 wt % up 0.01 wt %, or 0.01 wt % up to 1 wt % or, 0.1 wt % up to 1 wt %, or 1 wt % up 2 wt %, or 2 wt % up to 10 wt %, or 10 wt % to 20 wt %

The skilled person will appreciate that the weight proportion of graphene nanoparticles will depend on the intended application, and for example, whether the lubricant composition is in the form of a concentrate or a fully formulated lubricant.

In an embodiment, the graphene is substantially free of metal and semi-metal impurities. In one form, the metal or semi-metal impurities are selected from the group consisting of: Fe, Co, Cu, Mo, Ni, Si, and oxides thereof. By substantially free it is meant that there is less than 1 ppm total of the metal or semi-metal impurities. Preferably less than 1 ppb total of the metal or semi-metal impurities. Even more preferably, the metal or semi-metal impurities are less than the detectable limit.

In an embodiment, the lubricant composition is substantially free of graphene oxide and/or reduced graphene oxide. By substantially free it is meant that the graphene nanoparticles comprise graphene oxide and/or reduced graphene oxide in an amount of 1 wt % or less of the graphene, preferably 0.1 wt % or less, more preferably 0.01 wt % or less, and most preferably less than the detectable limit.

In an embodiment, the graphene nanoparticles have a size of from about 2 nm up to about 250 nm.

In an embodiment, the graphene nanoparticles comprise, consist essentially of, consist of, or are in the form of platelets or flakes.

In an embodiment, the graphene nanoparticles comprise, consist essentially of, consist of, or are formed from multiple layers of graphene.

In an embodiment, the lubricant composition further comprises a dispersant. Although in other forms, the lubricant composition does not comprise a dispersant. In embodiments in which a dispersant is present, it is preferred that the dispersant is present in an amount of from about 0.001 wt % up to about 2 wt %.

In one form of the above embodiment, the dispersant is selected from the group consisting of: polyisobutylene succinimides, (2-methoxymethylethoxy) propanol, octadecanoic acid, 12-hydroxy-polymer with alpha-hydro-omega-hydroxypoly (oxy1,2-ethanediyl, catalytic reformer fractionator, sulfonated, polymers with formaldehyde, sodium salts, Poly(oxy-1,2-ethanediyl), a-sulfo-w-[2,4,6tris (1-phenylethyl) phenoxy]-ammonium salt, Tristyrylphenol ethoxylates, polyalkylene oxide derivatives of alcohols, propane-1,2-diol, naphtha, base oil, and mineral oil combinations thereof.

In an embodiment of the second aspect, the method comprises providing graphene nanoparticles derived from a carbon containing gas.

In an embodiment of the second aspect, the step of dispersing the graphene nanoparticles comprises:

forming a mixture of graphene nanoparticles in the base oil or fully formulated lubricant; and subjecting the mixture to high-shear mixing.

In one form of the above embodiment, the high-shear mixing is carried out at a shear rate of from about 40,000 to about 60,000 $s^{-1}$.

In one form of the above embodiment, the step of subjecting the mixture to high-shear mixing is carried out for a time of from about 5 minutes to about 72 hours.

In an embodiment of the second aspect, the method further comprises adding a dispersant to the mixture.

In an embodiment of the second aspect, the method further comprises producing graphene nanoparticles from a carbon containing gas.

In a third aspect of the invention, there is provided a lubricant composition formed according to the method of the second aspect of the invention, and/or embodiments thereof, and/or forms thereof.

In a fourth aspect of the invention, there is provided the use of a lubricant composition according to the first or third aspects of the invention, and/or embodiments thereof, and/or forms thereof as a lubricant concentrate or a finished lubricant.

Any of the features described herein can be combined in any combination with any one or more of the other features described herein within the scope of the invention.

Preferred features, embodiments and variations of the invention may be discerned from the following Detailed Description which provides sufficient information for those skilled in the art to perform the invention. The Detailed Description is not to be regarded as limiting the scope of the preceding Summary of the Invention in any way.

DETAILED DESCRIPTION

The present invention relates to a lubricant composition that comprises a base oil or fully formulated lubricant with graphene derived from a carbon containing gas dispersed therein and methods of forming such a lubricant composition. The inventors have found that the use of graphene derived from a carbon containing gas enables longer and better dispersion of the graphene in the base oil or fully formulated lubricant as compared with graphene made in other ways, e.g. graphene derived from graphite.

The inventors have found that the lubricant composition of the present invention exhibits one or more of improved wear protection, heat transfer, mechanical heat protection, and reduces the corrosion of mechanical components.

Graphene derived from a carbon containing gas is different from graphene that is produced from graphite. Typical approaches to producing graphene from graphite include physical processes such as the micro-mechanical exfoliation of graphite or chemical processes such as the modified Hummer's method.

Exfoliation of graphite produces graphene by sloughing graphene layers from graphite. One issue with this method is that the resultant graphene includes any impurities that are present in the parent graphite, such impurities include Fe, Co, Cu, Mo, Ni, and Si (and oxides thereof). The presence of these impurities is undesirable in a lubricant composition as they have a deleterious effect on the dispersion of the graphene in the base oil and the resultant function of the lubricant composition and may in some instances be harmful to mechanical operations and metal componentry.

Modified Hummer's method involves the chemical oxidation of graphite to graphene oxide (GO). The graphene oxide can then be chemically reduced to a reduced graphene oxide (rGO). Briefly, the method includes treating graphite with an oxidising solution which may for example include potassium permanganate, sulfuric acid, and hydrogen peroxide to convert the graphite to graphene oxide. Graphene oxide contains oxidized functional groups such as hydroxyl, epoxy, and carboxyl groups. The graphene oxide may then be reduced to rGO using methods known to those skilled in the art, e.g. chemical, thermal, or electrochemical processes. Whilst this reduction process is suitable to reduce the overall density of oxidized functional groups, the resultant rGO still includes oxidized functional groups. The presence of graphene oxide, reduced graphene oxide, or these oxidized functional groups in a lubricant composition is undesirable as they have a deleterious effect on the dispersion of the graphene in the base oil and the resultant function of the lubricant composition and may in some instances be harmful to mechanical operations and metal componentry.

Further, the use of various chemical reagents to promote the conversion of graphite to graphene/GO/rGO also adds chemical impurities to the resultant graphene/GO/rGO which is undesirable in a lubricant composition, since these likewise have a deleterious effect on the lubricant, e.g. for the reasons expressed above.

In addition to the issue of impurities, these methods often result in little control over the final size of the resultant graphene/GO/rGO in terms of particle size and layer thickness, and often is in the form of multilayer Graphene/GO/rGO with a broad range of particle sizes.

In contrast with the above, graphene derived from carbon containing gas is of high purity. The absence of these impurities avoids the deleterious effects that these impurities would otherwise have on the lubricant composition.

The lubricant compositions may be formed by forming a mixture of a base oil (which may for example be one or more mineral base oils, semi-synthetic base oils, fully synthetic base oils, or mixtures thereof, otherwise known Group 1, Group 2, Group 3, Group 4, Group 5 base oils) or fully formulated lubricant with graphene in an amount of typically from amount of: 0.001 wt % up 0.01 wt %, or 0.01 wt % up to 1 wt %, or 0.1 wt % up to 1 wt %, or 1 wt % up 2 wt %, or 2 wt % up to 10 wt %, or 10 wt % to 20 wt %, depending on the intended application. The graphene is typically in the form of graphene nanoparticles having a size in the range of from about 2 nm and up to about 250 nm and exhibiting flake or platelet morphology.

Generally, where a lubricant concentrate is desired, the graphene may be present in an amount of from: 0.001 wt % up to 0.01%, 0.01 wt % up to 1%, 0.1 wt % up to 1 wt %, 1 wt % up to 2 wt %, 2 wt % up to 10 wt %, 10 wt % up to 20 wt %. In such cases the lubricant concentrate may be stored for a period of time before diluting to form a finished lubricant. Due to the high concentration of graphene and that the lubricant concentrate may be stored for a period of time prior to use, dispersibility of the graphene in the base oil is important. An advantage of graphene derived from carbon containing gas is that due to its high purity, for a given weight fraction the lubricant composition has a higher graphene particle loading than compared with graphene derived from less pure sources e.g. graphene derived from carbon containing gas may be used at an amount potentially up to 100 times less than other graphene to achieve the same or higher particle loading which contributes to the enhanced properties of the lubricant composition.

The lubricant concentrate may be diluted with one or more base oils which may be the same or different from the base oil of the lubricant concentrate to form the finished lubricant.

Alternative, where a finished lubricant is desired, the graphene may be present in an amount of from 0.001 wt % up 0.01%, 0.01 wt % up to 1%, 0.01 wt % up to 1%, 1 wt % up 2 wt %, 2 wt % up to 10 wt %, 10 wt % to 20 wt %

In either case, the graphene is added to the base oil and subjected to high-shear mixing to suspend the graphene in the base oil. The inventors have found that mixing at a shear rate of at least 40,000 $s^{-1}$ is beneficial for dispersing the graphene in the base oil. High-shear mixing may occur for a period of from about 5 minutes to about 72 hours depending upon the nature of the graphene, type of base oil, and presence of additives.

A dispersant may also be used to increase the stability or homogeneity of the dispersion and prolong product shelf-life. If a dispersant is used, this is typically added in amount of from about 0.001 wt % up to about 2 wt %. A range of suitable dispersants may be used, for example, ionic and non-ionic surfactants, polymers, copolymers, and mixtures thereof. Suitable dispersants include: polyisobutylene succinimides, (2-methoxymethylethoxy) propanol, octadecanoic acid, 12-hydroxy-polymer with alpha-hydro-omega-hydroxypoly (oxy1,2-ethanediyl, catalytic reformer fractionator, sulfonated, polymers with formaldehyde, sodium salts, Poly(oxy-1,2-ethanediyl), a-sulfo-w-[2,4,6tris(1-phenylethyl) phenoxy]-ammonium salt, Tristyrylphenol ethoxylates, polyalkylene oxide derivatives of alcohols, propane-1,2-diol, naphtha, or commercially available dispersants such as DYSPERBYK 194N, DYSPERBYK 192, DYSPERBYK 199, DYSPERBYK 2013, DYSPERBYK 2015, Triton X-100, Brij L23, BrijO10, Ecoteric T20, Hydrapol RP40, Hydrapol RP90, Tersperse 2020, Tersperse 2218, Tersperse 2218, Tersperse 2288, Tersperse 2500, Tersperse 2510, and combinations of the foregoing.

Example 1

Lubricant concentrates were prepared by mixing mineral base oils, semi-synthetic base oils, and fully synthetic base oils with graphene derived from a carbon containing gas at a wt % ranging from 0.001 wt % up 0.01%, 0.01 wt % up to 1%, 0.01 wt % up to 1%, 1 wt % up 2 wt %, 2 wt % up to 10 wt %, 10 wt % to 20 wt % using a high-shear mixer. The lubricant concentrates were then diluted to a final graphene concentration of 0.001 wt % up to 0.01%, 0.01 wt % up to 1%, 0.01 wt % up to 1%, 1 wt % up 2 wt %, 2 wt % up to 10 wt %, 10 wt % to 20 wt % for the finished lubricants depending on initial concentration and final intended concentration.

The finished lubricants were then subjected to modified ASTM 4 Ball Wear tests and compared with the results of the same base oil or fully formulated lubricant alone absent the graphene. The results are shown in Table 1 below:

TABLE 1

| modified ASTM test results | | |
|---|---|---|
| Modified ASTM D2783 | Extreme Pressure Test for lubricating fluids | Improvement up to 5% |
| Modified ASTM D4172 | Wear Preventative Test for lubricating fluids | Improvement up to 20% |

Example 2

This example reports experimental results obtained by mixing Group 3 and Group 4 base oils with 0.01 wt % graphene using a high-shear mixer in the absence of a dispersant. The graphene was multilayer graphene with particle sizes in the range of 2-250 nm.

Table 2 below illustrates that the addition of graphene resulted in significant improvements in the COF (coefficient of friction) of both Group 3 and Group 4 base oils.

TABLE 2

Results showing improved COF in a Group 3 base oil

| Description | Average COF | Graphene concentration (wt %) | ΔCOF from control (%) | Graphene particle size (nm) | Dispersant |
|---|---|---|---|---|---|
| Group 3 Base oil (Control) | 0.164 | 0.00 | N/A | 2-250 | N/A |
| Group 3 Base oil | 0.095 | 0.01 | −42.10 | 2-250 | N/A |
| Group 3 Base oil | 0.096 | 0.01 | −41.50 | 2-250 | N/A |
| Group 3 Base oil | 0.101 | 0.01 | −38.40 | 2-250 | N/A |
| Group 4 Base oil (Control) | 0.103 | 0.00 | N/A | 2-250 | N/A |
| Group 4 Base oil | 0.089 | 0.01 | −13.50 | 2-250 | N/A |
| Group 4 Base oil | 0.094 | 0.01 | −8.70 | 2-250 | N/A |
| Group 4 Base oil | 0.094 | 0.01 | −8.70 | 2-250 | N/A |

Example 3

This example reports experimental results obtained by mixing a commercially available oil from Shell with 0.01 wt % graphene using a high-shear mixer in the presence of a dispersant.

The graphene was multilayer graphene with particle sizes in the range of 2-250 nm.

Table 3 below illustrates that the addition of graphene resulted in significant improvements in the COF (coefficient of friction) of the commercially available shell oil.

TABLE 3

Results showing improved COF in a commercially available oil from Shell

| Description | Average COF | Graphene concentration (wt %) | ΔCOF from control (%) | Graphene particle size (nm) | Dispersant |
|---|---|---|---|---|---|
| Shell Oil (Control) | 0.098 | 0.00 | N/A | 2-250 | N/A |
| Shell Oil | 0.090 | 0.01 | −8.16 | 2-250 | Yes |

The experiment was repeated with a range of dispersants including: polyisobutylene succinimides, (2-methoxymethylethoxy) propanol, octadecanoic acid, 12-hydroxy-polymer with alpha-hydro-omega-hydroxypoly(oxy1,2-ethanediyl, catalytic reformer fractionator, sulfonated, polymers with formaldehyde, sodium salts, Poly(oxy-1,2-ethanediyl), a-sulfo-w-[2,4,6tris(1-phenylethyl)phenoxy]-ammonium salt, Tristyrylphenol ethoxylates, polyalkylene oxide derivatives of alcohols, propane-1,2-diol. In each case, the experiments yielded similar results.

A person skilled in the art will appreciate that many embodiments and variations can be made without departing from the ambit of the present invention. Reference throughout this specification to 'one embodiment' or 'an embodiment' means that a particular feature, structure, or characteristic described in connection with the embodiment is included in at least one embodiment of the present invention. Thus, the appearance of the phrases 'in one embodiment' or 'in an embodiment' in various places throughout this specification are not necessarily all referring to the same embodiment. Furthermore, the particular features, structures, or characteristics may be combined in any suitable manner in one or more combinations.

The invention claimed is:

1. A lubricant composition comprising:

a base oil or a fully formulated lubricant; and graphene nanoparticles derived from a carbon containing gas dispersed in the base oil or the fully formed lubricant; and wherein the graphene nanoparticles are present at a concentration of from 0.001 wt % up to 0.01 wt % of the total weight of the lubricant composition.

2. The lubricant composition of claim 1, wherein the graphene nanoparticles comprise less than 1 ppm total of metal and semi-metal impurities selected from the group consisting of: Fe, Co, Cu, Mo, Ni, Si, and oxides thereof.

3. The lubricant composition of claim 1, wherein the graphene nanoparticles comprise graphene oxide and/or reduced graphene oxide in an amount of 1 wt % or less of the graphene nanoparticles.

4. The lubricant composition of claim 1, wherein the graphene nanoparticles have a size of from 2 nm up to 250 nm.

5. The lubricant composition of claim 1, wherein the graphene nanoparticles are in the form of platelets or flakes.

6. The lubricant composition of claim 1, wherein in the graphene nanoparticles are formed from multilayer graphene.

7. The lubricant composition of claim 1, wherein the graphene nanoparticles consist of multilayer graphene.

8. The lubricant composition of claim 1, wherein the lubricant composition further comprises a dispersant.

9. The lubricant composition of claim 8, wherein the dispersant is present in an amount of from 0.05 wt % up to 2 wt %.

10. The lubricant composition of claim 8, wherein the dispersant is selected from the group consisting of: polyisobutylene succinimides, (2-methoxymethylethoxy) propanol, octadecanoic acid, 12-hydroxy-polymer with alpha-hydro-omega-hydroxypoly (oxy1,2-ethanediyl, catalytic reformer fractionator, sulfonated, polymers with formaldehyde, sodium salts, poly(oxy-1,2-ethanediyl), a-sulfo-w-[2,4,6tris(1-phenylethyl)phenoxy]-ammonium salt, tristyrylphenol ethoxylates, polyalkylene oxide derivatives of alcohols, propane-1,2-diol, base oil, mineral oil naphtha, and combinations thereof.

11. A method for preparing a lubricant composition comprising:

dispersing graphene nanoparticles derived from a carbon containing gas in a base oil or a fully formulated lubricant, wherein the graphene nanoparticles are dispersed at a concentration of from 0.001 wt % up to 0.01 wt % of the total weight of the lubricant composition.

12. The method of claim 11, wherein the step of dispersing the graphene nanoparticles comprises:

forming a mixture of graphene nanoparticles in the base oil or the fully formulated lubricant; and subjecting the mixture to high-shear mixing.

13. The method of claim 12, wherein the high-shear mixing is carried out at a shear rate of from 40,000 to 60,000 $s^{-1}$.

14. The method of claim 12 wherein the step of subjecting the mixture to high-shear mixing is carried out for a time of from 5 minutes to 72 hours.

15. The method of claim 12, wherein the method further comprises adding a dispersant to the mixture.

16. A lubricant composition formed according to the method of claim 11.

17. A method of using a lubricant composition, comprising:

obtaining a lubricant composition comprising a base oil or a fully formulated lubricant and graphene nanoparticles derived from a carbon containing gas dispersed in the base oil or the fully formed lubricant, wherein the graphene nanoparticles are present at a concentration of from 0.001 wt % up to 0.01 wt % of the total weight of the lubricant composition; and applying the lubricant composition to a location in need of lubrication.

* * * * *